US007562441B2

(12) United States Patent
Conte

(10) Patent No.: US 7,562,441 B2
(45) Date of Patent: Jul. 21, 2009

(54) CRIMP PRESS FOR THE PRODUCTION OF A CRIMPING CONNECTION

(75) Inventor: Alois Conte, Ebikon (CH)

(73) Assignee: Komax Holdings AG, Dierikon (CH)

( * ) Notice: Subject to any disclaimer, the term of this patent is extended or adjusted under 35 U.S.C. 154(b) by 202 days.

(21) Appl. No.: 10/387,632

(22) Filed: Mar. 13, 2003

(65) Prior Publication Data

US 2003/0172529 A1 Sep. 18, 2003

(30) Foreign Application Priority Data

Mar. 18, 2002 (EP) ..... 02405209

(51) Int. Cl.
*H01R 43/00* (2006.01)

(52) U.S. Cl. ..... 29/748; 29/749; 29/759; 29/33 M

(58) Field of Classification Search ..... 29/33 M, 29/748, 759, 749
See application file for complete search history.

(56) References Cited

U.S. PATENT DOCUMENTS 3,455,006 A * 7/1969 Reem et al. ..... 29/566
4,361,942 A * 12/1982 Mazzola et al. ..... 29/33 M
4,713,880 A 12/1987 Dusel et al.
6,212,757 B1 4/2001 Hasegawa
6,266,870 B1 7/2001 Wollermann et al.

FOREIGN PATENT DOCUMENTS

EP 1 079 479 2/2001

* cited by examiner

*Primary Examiner*—Rick K Chang
(74) *Attorney, Agent, or Firm*—Fraser Clemens Martin & Miller LLC; William J. Clemens

(57) ABSTRACT

A crimp press has a positioning unit for lowering a grip arm supplying a cable end to a crimp device. The positioning unit is arranged on a handle firmly connected with a tool holder. Vertical movement of the handle with the positioning unit corresponds to the vertical movement of the tool holder during the crimping operation. Adjustment to different crimp devices and/or different crimping contact types is provided by a bar of the positioning unit being adjustable in vertical direction and automatically lockable and releasable.

8 Claims, 6 Drawing Sheets

22
21
12
20
23
24
13
13.1
SH

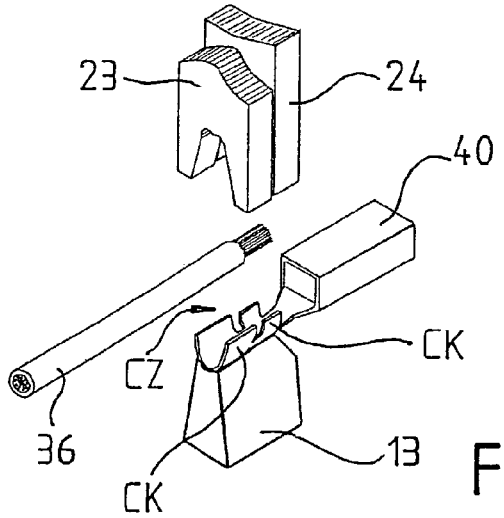
Fig. 9
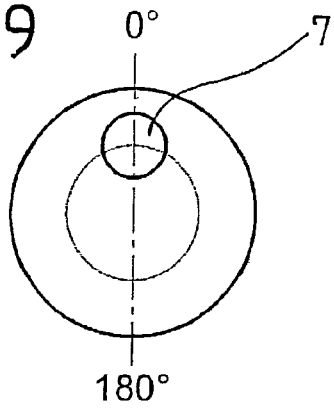
Fig. 10
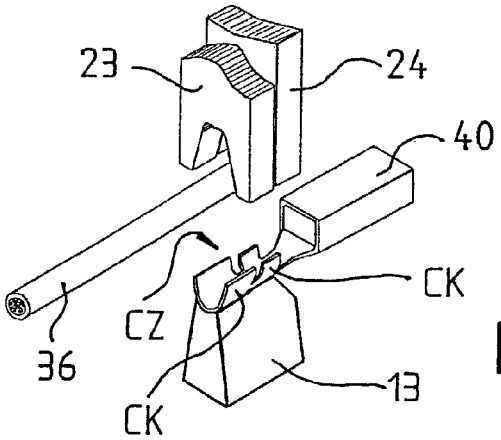
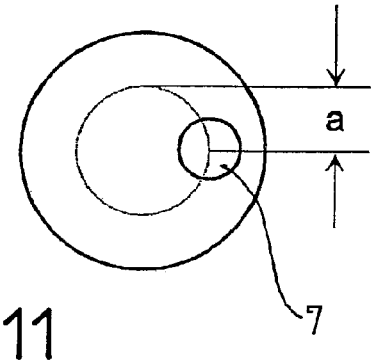
Fig. 11
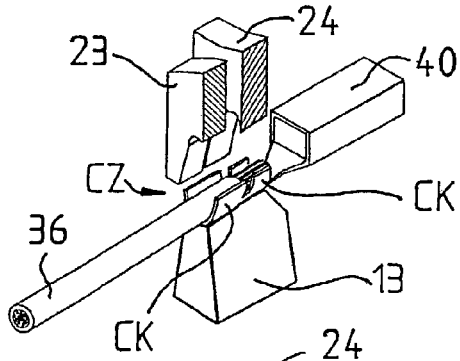
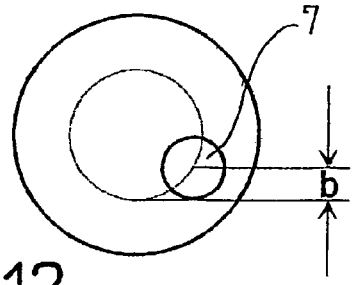
Fig. 12
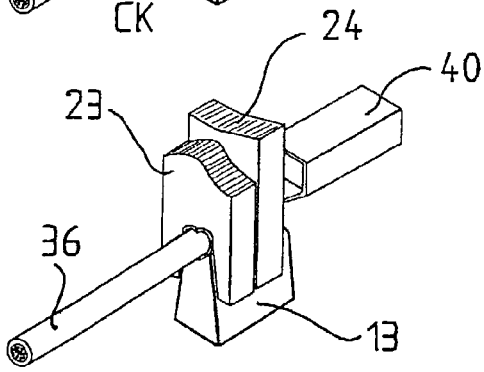
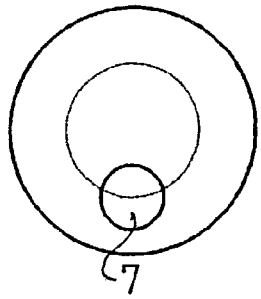

CRIMP PRESS FOR THE PRODUCTION OF A CRIMPING CONNECTION

BACKGROUND OF THE INVENTION

The present invention relates to a crimp press for the production of a crimping connection by means of a driven crimp device, which device connects a cable end with a crimping contact, whereby a grip arm supplies the cable end to the crimp press and a positioning unit vertically moves the grip arm during the crimping operation.

The closing height SH (shut height) of the crimp device, as shown in FIGS. 1 and 2, is standardized and amounts, for example, to 135.8 mm. The vertical insertion position of the crimping contact can vary however, depending upon construction and manufacturer, up to approximately 5 mm. The cable feeder, being for example for swivelling machines with a swivel arm having a grip arm at the free end, brings the stripped cable in position some millimeters over the crimping zone, respectively over the crimping claws of an open crimping contact. When downwards moving the crimping stamp (usually one crimping stamp for the cable sheath and for the insulation), the grip arm of the swivel arm must be moved simultaneously with the crimping stamp of the crimp device (driven for example by means of an eccentric and a drive) downwards against a compression spring. Be that not the case, or be that too inaccurate (more than about 2 mm of deviation), the so-called insertion depth (correct position of the cable for the crimping contact) will vary correspondingly, because the cable, during the crimping operation, is either stretched or tossed between the crimping contact and the grip arm and that can lead to inadmissible quality losses.

The positioning units used so far consist of a handle (fastened to the carriage or to the tool holder) and a screw, made of synthetic material, with long shank with lock nut. The eccentric press is driven to the being arranged mode (manual over hand-wheel at the motor shaft or in creep speed) to the lower dead center position. In this position, the screw is adjusted opposite to the grip arm of the swivel arm in such a way that the cable exhibits a clearance to the fixed crimping anvil of approximately the plate thickness of the crimping contact. Afterwards, the screw is fastened by means of the lock nut.

A crimp press is shown the U.S. Pat. No. 6,266,870 by means of which a terminal of a cable is connectable with a crimping contact. The cable end is supplied by means of a grip arm to the crimp press, whereby the cable end is positioned above the crimping zone of the crimping contact and the crimping zone leans on an anvil. During the crimping operation, a positioning unit is moved along with the crimping device, whereby the positioning unit lowers the grip arm holding the cable end. At the same time, the cable end will be inserted into the open crimping zone before the crimping stamps of the crimping device produce the crimping connection. In addition, the positioning unit can be moved out from the grip arm area, if crimping contacts with closed crimping areas are processed.

A disadvantage of this well-known installation is that the positioning unit, for a specific type of contact and for a specific crimping device, is mechanically firmly adjusted.

SUMMARY OF THE INVENTION

The present invention concerns a crimp press for the production of a crimping connection utilizing a driven crimp device to connect a cable end with a crimping contact, wherein a grip arm supplies the cable end to the crimp press.

The crimp press comprises: a crimp device moveable along a predetermined path; and a positioning unit attached to the crimp device and adapted to engage the grip arm, the positioning unit having an operating means being adjustable along the predetermined path, the operating means being automatically lockable in and releasable from a plurality of positions along the predetermined path. The crimp press operating means includes a bar guided in a housing, the bar being pressured in one direction along the predetermined path by a spring means arranged on the housing.

The crimp press bar has a gear tooth forming thereon engaging with a toothed connecting link guided in the housing, and including another spring means pressurizing the link into engagement with the gear tooth forming. The toothed connecting link is operated by an actuator, whereby when the actuator is activated, the actuator counteracts a spring resistance of the another spring means releasing engagement between the link and the gear tooth forming. The crimp device is oriented for movement in a generally vertical direction along the predetermined path.

The present invention also concerns a method for the production of a crimping connection utilizing a driven crimp device to connect a cable end with a crimping contact, wherein a grip arm supplies the cable end to the crimp press. The method comprises the steps of: providing a positioning unit on a crimp press; and prior to a crimping connection operation, setting an operating element of the positioning unit in a predetermined position along a crimping connection operation path utilizing the crimp press and the grip arm, the predetermined position producing necessary movement of the grip arm during the crimping connection operation. The setting step is performed with the steps of: moving the operating element of the positioning unit to a position corresponding to an upper dead center position of the crimp device and fully extending the operating element along the crimping connection operation path; moving the crimp device along the crimping connection operation path until the operating element contacts the grip arm, and storing a distance covered as a first distance; moving the crimp device further along the crimping connection operation path until a cable end carried by the grip arm enters a crimping zone of a crimping contact, and storing a distance to be covered to a lower dead center position of the crimp device as a second distance; and returning the crimp device to the upper dead center position and releasing the operating element of the positioning unit, whereby during subsequent crimping connection operations, the crimp device is moved along the crimping connection operation path a distance equal to the first distance plus the second distance and the operating element is retracted by the grip arm and locked in this position.

The crimp press according to the present invention solves the objective of avoiding the disadvantages of the well-known installation and provides an installation by which, during the transition between different types of crimping contacts and/or crimping devices, no adjustment and conversion works arise on the crimp press due to the positioning unit.

The advantages of the crimp press according to the present invention are that the positioning unit, depending upon to the processed type of crimping contact and upon to the crimping device, can position itself automatically in a vertical direction. The productivity of the crimp press can be substantially increased thereby, in particular when small numbers of the same crimping contacts are processed. The crimp device, according to the present invention, offers the possibility of driving successively, with few conversion works and minimum downtimes, several different contact types.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 9 is a perspective view of the anvil and the crimping stamps with an eccentric pin of the crimp press in the upper dead center position;

FIG. 10 is a view similar to FIG. 9 with the eccentric pin moved a vertical distance "a" from upper dead center;

FIG. 11 is a view similar to FIG. 9 with the eccentric pin a distance "b" above lower dead center for inserting a cable into a crimping zone of a crimping contact; and FIG. 12 is a view similar to FIG. 9 with the eccentric pin in the lower dead center position.

DESCRIPTION OF THE PREFERRED EMBODIMENT

Figure 1:
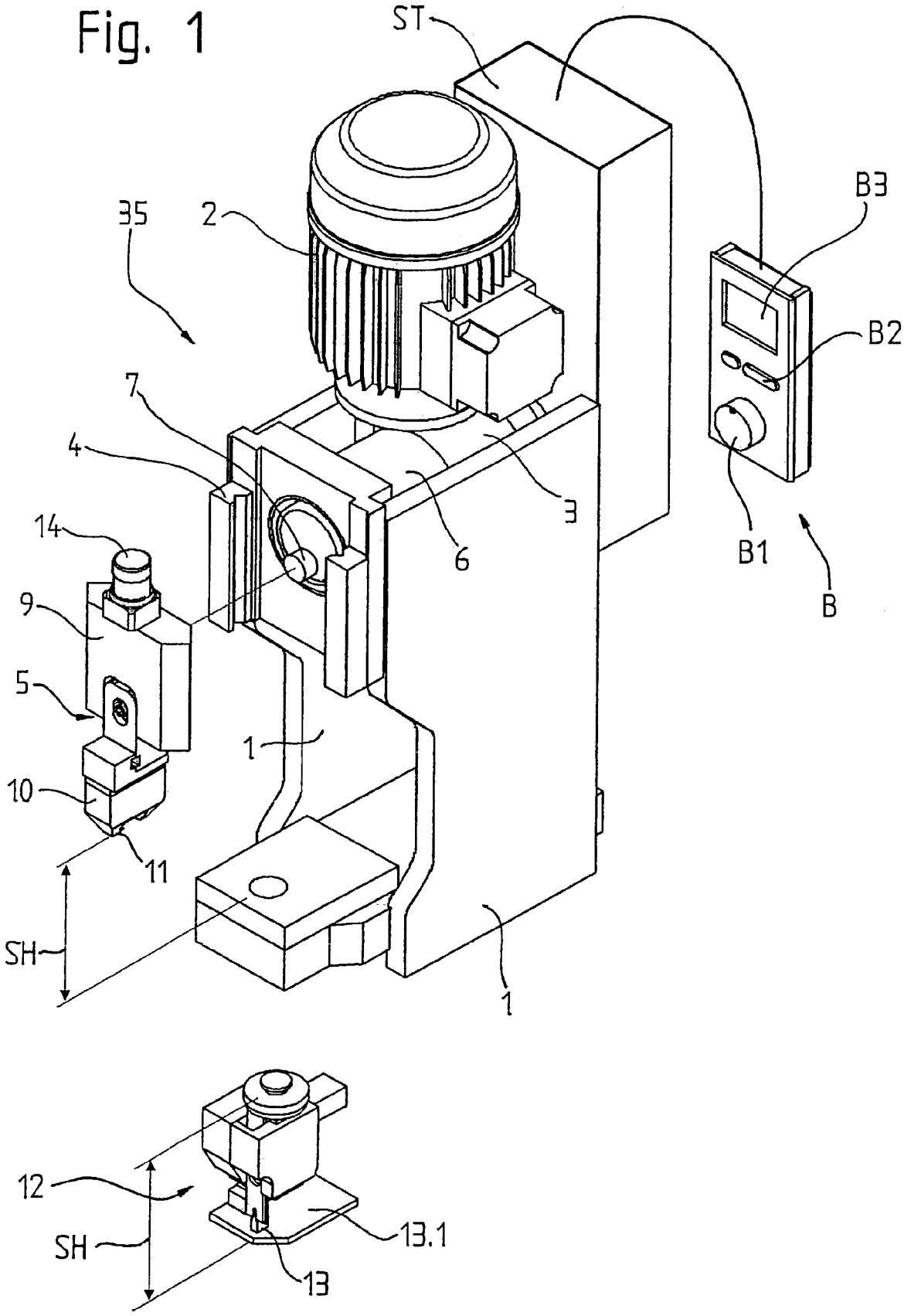
FIG. 1 is a perspective view of a crimp press according to the present invention with a crimp device for the production of a crimping connection.

A crimp press 35 is shown in FIG. 1 having a stand 1 on which an engine 2 and a gearing 3 are mounted. In addition, first guides 4 are arranged on the stand 1 in which a crimping ram 5 is guided. A shaft 6, driven by the gearing 3, has a free end with an eccentric pin 7. The crimping ram 5 consists of a carriage 9 guided by first guides 4 and having a tool holder 10 with a fork arm 11. The carriage 9 stands in loose connection with the eccentric pin 7, whereby the rotation of the eccentric pin 7 is converted into a linear up and down movement of the carriage 9 along a predetermined path. The maximum stroke of the carriage 9 is determined by an upper dead center position and a lower dead center position of the eccentric pin 7. The tool holder 10 operates a crimp device 12, which makes, together with an anvil 13, the crimping connection. The anvil 13 is arranged on an anvil plate 13.1. By means of an adjusting screw 14 on the carriage 9, the closing height SH (shut height) can be precisely adjusted in the lower dead center position of the eccentric pin 7. In case no adjusting wheel is provided for the crimp device 12, the crimping height can be adjusted with the adjusting screw 14. (Measure between the anvil 13 and the crimping stamp in the lower dead center position of the eccentric pin 7.)

As an interface between an operator and the crimp press 35, an operator terminal B is provided. For the input of operational data and instructions to a control, the operator terminal B includes a turning knob B1 and a keyboard B2 and, for the visualization of data, an indicator display B3 is provided. The operator terminal B is connected with a control ST of the crimp press 35.

Instead of the eccentric driving gear shown in FIG. 1, a hydro-pneumatic linear driving gear or a toggle lever driving gear can, for example, be used.

Figures 2, 3:
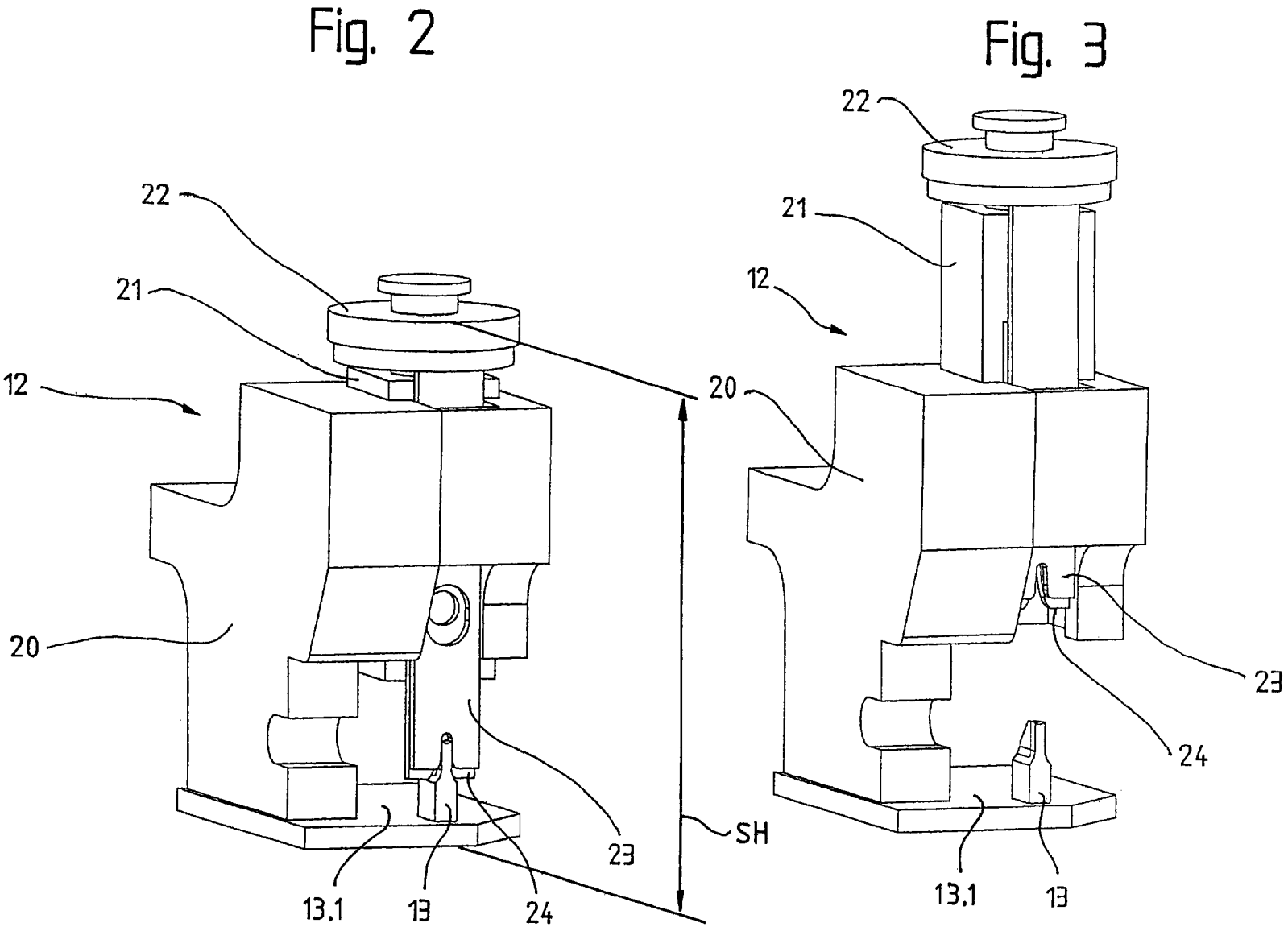
FIG. 2 is a perspective view of the crimp device shown in FIG. 1 with crimping stamps in a lower dead center position.
FIG. 3 is a view similar to FIG. 2 with the crimping stamps in an upper dead center position.

FIGS. 2 and 3 show details of the crimp device 12 for the production of a crimping connection. A stamp support 21, which is guided into a device housing 20, comprises a support head 22, which stays in loose connection with the fork arm 11 of the tool holder 10. On the stamp support 21 are arranged a first crimping stamp 23 and a second crimping stamp 24, which stamps together produce, with the correspondingly formed anvil 13, the crimping connection. The crimping stamp 23 is intended for the insulation-crimp and the second crimping stamp 24 is intended for the wire-crimp. FIG. 2 shows the crimping stamps 23 and 24 in the lower dead center position of the eccentric pin 7, in which the production of the crimping connection is terminated. FIG. 3 shows the crimping stamps 23 and 24 in the upper dead center position of the eccentric pin 7. The maximum stamp stroke is determined between the dead center positions, whereby the one laying at 0° upper dead center and the one laying at 180° lower dead center of the eccentric pin 7 must not be crossed. The upper dead center and the lower dead center can deviate from 0° to 180° respectively by using the operator terminal B and the control ST to select different positions.

Figure 4:
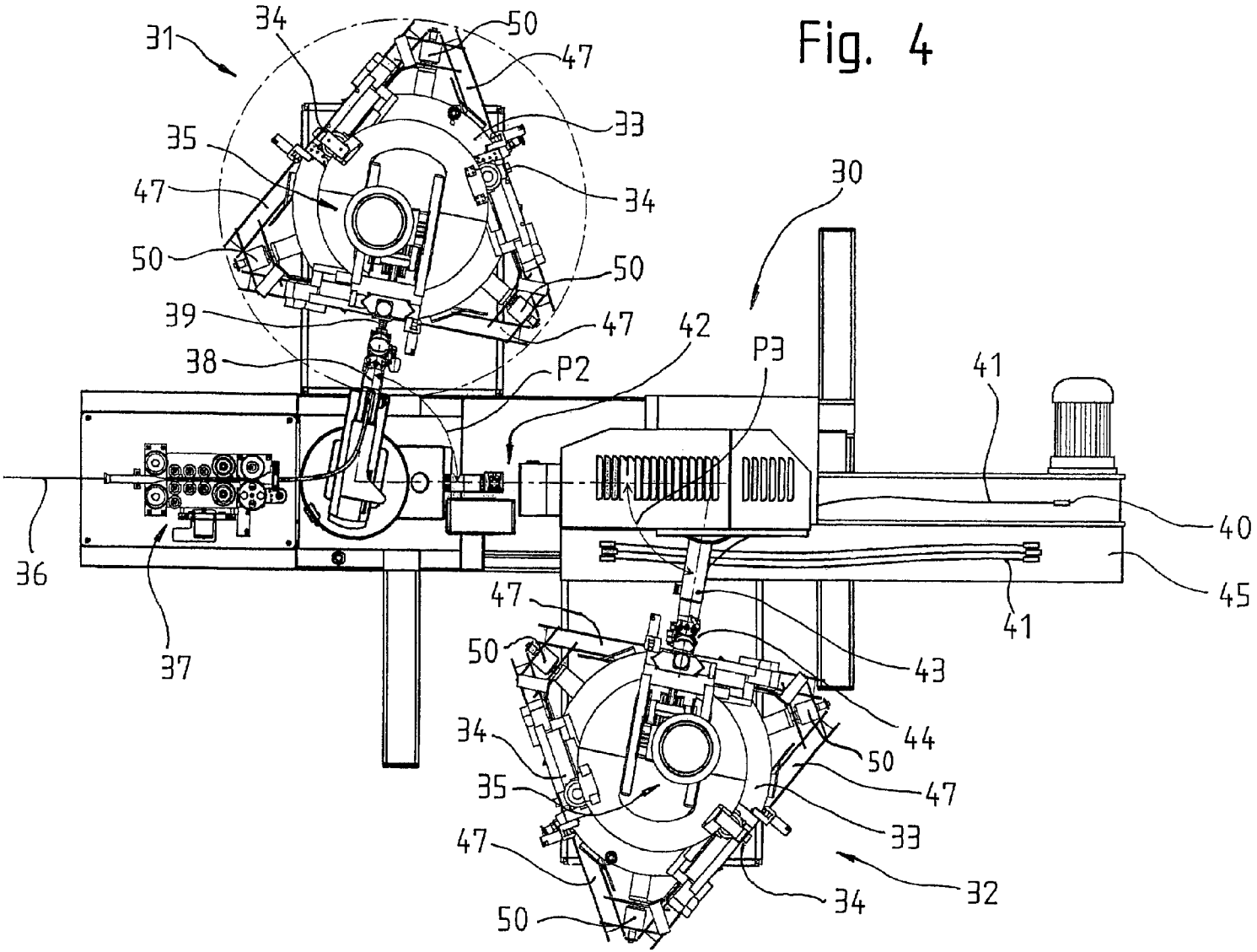
FIG. 4 is a plan view of a crimping installation with a first and a second crimping station including the crimp press and crimp device shown in FIG. 1.

FIG. 4 shows a crimping installation 30 with a first crimping station 31 and a second crimping station 32 positioned on opposite sides of a cable path of travel. Each of the crimping stations 31 and 32 includes a device platform 33 having mounted thereon a plurality of device stations 34 and the crimp press 35 foreseen. The crimping stations 31 and 32 are identical in their structure. A cable 36 is advanced by means of a tape drive 37, whereby a leading cable end is taken over by a first grip arm 39 at a free end of a first swivel arm 38. The first grip arm 39 supplies the stripped cable end to the first crimping station 31. The movement of the first grip arm 39 is indicated with an arrow P2. After the leading cable end is provided with a crimping contact 40, the first swivel arm 38 moves back to an axis of the tape drive 37 defining the cable path. Thereafter, the tape drive 37 pushes the cable 36 further forward until the desired length of a cable section 41 is reached. A separation and stripping station 42 separates the cable section 41 from the cable 36 and removes the insulation at the adjoining new cable ends. The lagging end of the cable section 41 is taken over by a second grip arm 44 arranged on a free end of a second swivel arm 43. The second grip arm 44 supplies the lagging cable end to the second crimping station 32 for assembly with another one of the crimping contacts 40. The movement of the second grip arm 44 is indicated with an arrow P3. The new leading cable end of the cable 36 will be supplied for assembly with one of the crimping contacts 40 by means of the first swivel arm 38 and by means of the first grip arm 39 of the first crimping station 31. After assembly, the cable section 41 is moved into a deposit station 45.

Figure 5:
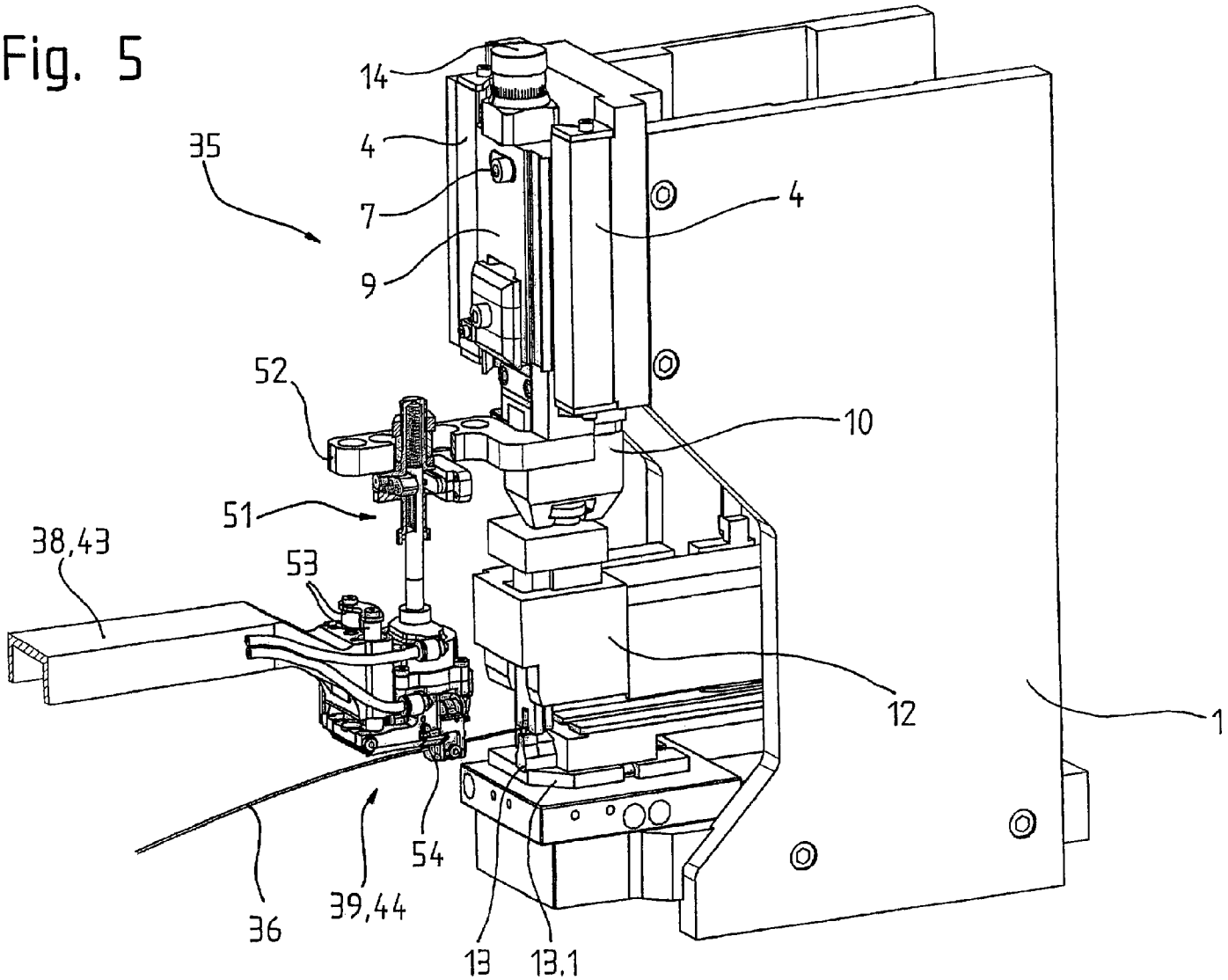
FIG. 5 is a perspective view of the crimp press shown in FIG. 1 with a positioning unit for lowering a grip arm, which supplies a cable end.

FIG. 5 shows the crimp press 35 with a positioning unit 51, which in accordance with the invention, lowers the grip arm 39 or 44 supplying the cable end of the cable 36. The positioning unit 51 is arranged on a handle 52, which handle is firmly connected with the tool holder 10. The vertical movement of the handle 52 corresponds to the vertical movement of the tool holder 10.

The grip arm 39 or 44 is mounted in a vertically mobile manner along a pair of guides 53 by means of a bearing at the end of the swivel arm 38 or 43 respectively, whereby springs (not shown) hold the grip arm 39 or 44 in the upper final position. Pneumatically activated grip fingers 54 on the grip arm 39 or 44 firmly hold the cable 36. During the lowering of the positioning unit 51, the positioning unit counteracts in the vertical direction the spring resistance of the grip arm 39 or 44, whereby the positioning unit 51 will determine the movement of the grip arm 39 or 44 and end of the cable 36. With the lowering movement of the grip arm 39 or 44, the end of the cable 36 is inserted into an open crimping zone CZ of the crimping contact 40, formed by crimping claws CK as shown in more detail in FIGS. 9 through 12.

Figure 6:
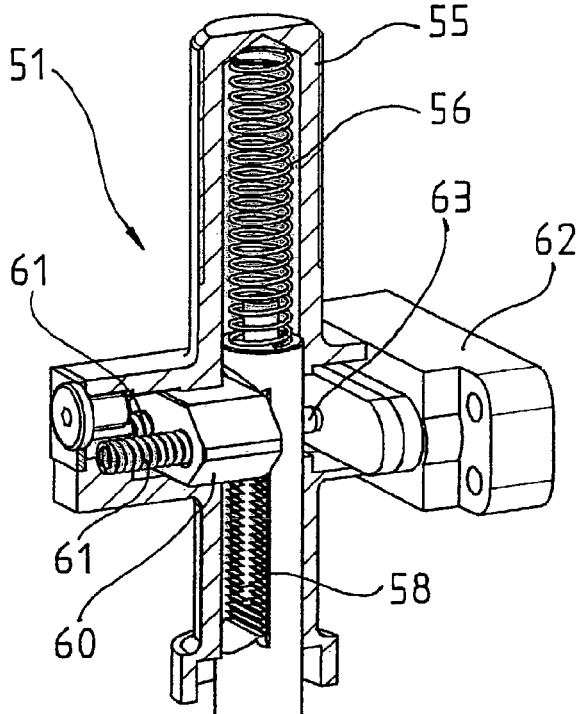
FIG. 6 is an enlarged perspective view of the positioning unit shown in FIG. 5.

FIG. 6 shows details of the positioning unit 51 arranged on the handle 52. A compression spring 56, being mounted in a hollow upper interior of a cross-shaped housing 55, presses on a bar 57, which bar is provided with a vertically extending gear tooth forming 58 configured as a toothed rack recessed into the side of the bar. The bar 57 is guided into an open bottom of the housing 55 and it exhibits a buffer 59 at a lower end. The gear tooth forming 58 engages with a toothed connecting link 60, which link is being guided into a housing 55, whereby a pair of compression springs 61 pressurize the toothed connecting link 60 with a spring resistance. An actuator 62, being for example a pneumatic cylinder, counteracts, in an activated state, the spring resistance of the compression springs 61 by means of a thrust pin 63, whereby the engagement between the toothed connecting link 60 and the gear tooth forming 58 is released.

Figure 7:
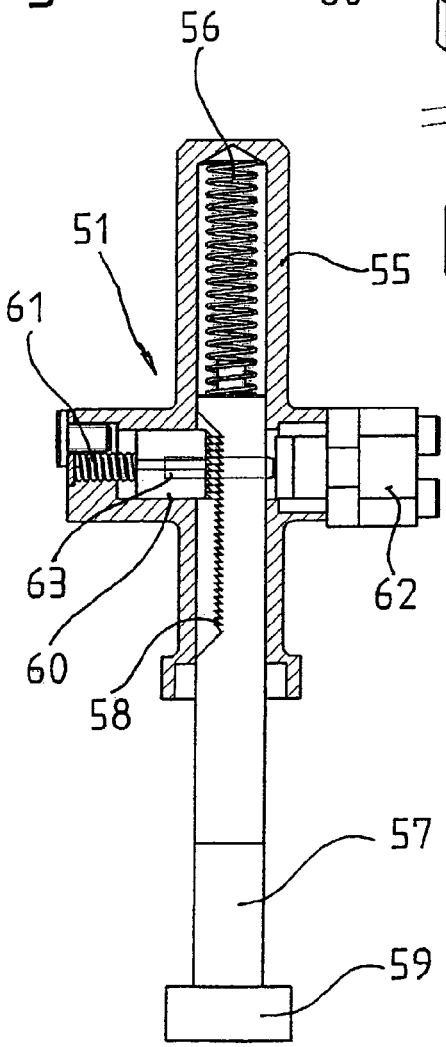
FIG. 7 is a view similar to FIG. 6 with a positioning bar in an extended position.

FIG. 7 shows the positioning unit 51 with the actuator 62 activated, whereby the toothed connecting link 60 is released against the spring resistance of the compression springs 61 from the engaged position with the gear tooth forming 58. By means of the compression spring 56, the bar 57 is fully driven out wherein the top of the recess for the gear tooth forming 58 is adjacent to the link 60.

Figure 8:
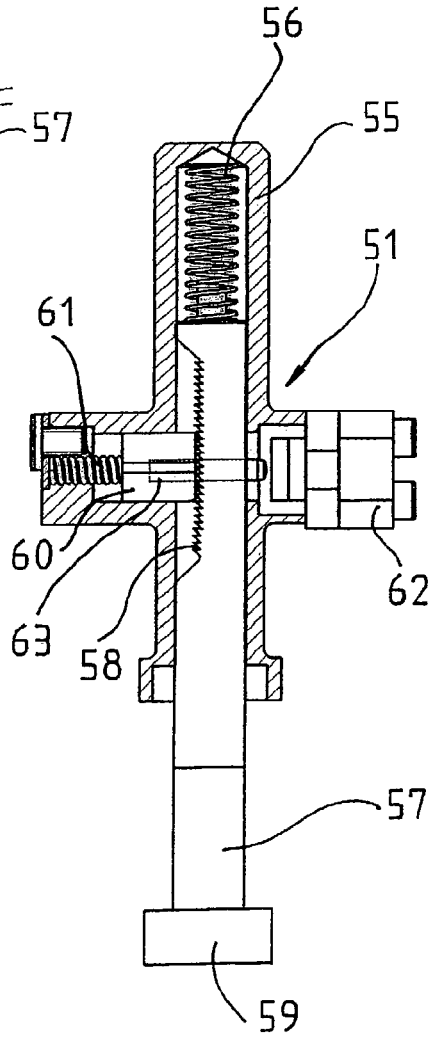
FIG. 8 is a view similar to FIG. 6 with a positioned and mechanically locked positioning bar.

FIG. 8 shows the positioning unit 51 with the actuator 62 deactivated, whereby the previously positioned bar 57, serving as operating element, engages, by means of the gear tooth forming 58, with the toothed connecting link 60 under the effect of the compression springs 61.

The positioning of the bar 57 in vertical direction, and thereby the position of the buffer 59, is accomplished as follows:

FIG. 9 shows the eccentric pin 7 of the crimp press 35 in the upper dead center 0° position to the right and the corresponding position of the crimping stamps 23 and 24 to the left. (When the eccentric pin is in the upper dead center position, also the crimping device is in the upper dead center position.) The cable 36 is positioned, by means of the grip arm 39 or 44, above the crimping zone CZ of the crimping contact 40. The bar 57 is in the position as shown in FIG. 7, whereby the actuator 62 is deactivated and the gear tooth forming 58 is engaged with the toothed connecting link 60.

FIG. 10 shows the eccentric pin 7 of the crimp press 35 after moving clockwise a vertical distance "a" from the upper dead center position shown in FIG. 9, and the corresponding position of the crimping stamps 23 and 24. The bar 57, with the buffer 59, is stepped thereby into contact with the grip arm 39 or 44. The control ST notes this position, for example, by means of a sensor arranged on the grip arm 39 or 44. The position value can also be detected by means of an encoder arranged on the engine 2, or by means of a linear measuring system arranged on the crimp press 35, or by means of a hand measurement, through a slide gage, and transmitted to the control ST. Then, the eccentric pin 7 will be moved further downwards, by means of the regulated engine 2, whereby the buffer 59 will also further move downwards the grip arm 39 or 44 with the cable 36 or cable section 41.

FIG. 11 shows the eccentric pin 7 of the crimp press 35 after clockwise movement a vertical distance for inserting the cable 36 into the crimping zone CZ of the crimping contact 40, whereby the cable rests on the crimping element of the crimping contact 40. A vertical distance "b" of the eccentric pin 7 from the lower dead center 180° position is obtained from the control ST. (When the eccentric pin 7 is in the lower dead center position, the crimping device 12 is also in the lower dead center position.) Thereafter, the eccentric pin 7 is moved clockwise, vertically moving together with the carriage 9, the tool holder 10 and the crimping stamps 22 and 23 to proceed again into the upper dead center position (FIG. 9) and the actuator 62 will be activated to release the engagement between the toothed connecting link 60 and the gear tooth forming 58.

Subsequently, the eccentric pin 7 is moved clockwise and downwards, whereby the bar 57 and the buffer 59, by hitting the strongly pressure-suspended grip arm 39 or 44, will be pushed in or respectively pushed back around the distance "b", because the compression spring 56 of the positioning unit 51 is substantially weaker than the compression springs 61 of the grip arm 39 or 44. Thereafter, the actuator 62 is deactivated, whereby the before positioned bar 57 engages, by means of the gear tooth forming 58 and under the effect of the compression springs 61, with the toothed connecting link 60. The positioning unit 51 is now correctly set for the used device 12, for the to be moved contact type 40 and for the conductor 36. The measured values "a" and "b" may be stored together with a device identification in the control ST. In the instance of repetition, the crimp press 35 can renew and automatically undertake the positioning of the bar 57 and the buffer 59. The upper and the lower dead center positions must not be 0° and 180° respectively.

FIG. 12 shows the eccentric pin 7 of the crimp press 35 in the lower dead center position and the corresponding position of the crimping stamps 23 and 24 after the crimping operation. The crimping claws CK embrace the cable sheath and the bare conductor and are plastic deformed by the crimping operation.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A crimp press for the production of a crimping connection utilizing a driven crimp device to connect a cable end with a crimping contact, wherein a grip arm supplies the cable end to the crimp press, the crimp press comprising:

a crimp device moveable along a first predetermined path for connecting the cable end with the crimping contact, the first predetermined path being transverse to a longitudinal axis of the cable end; and a positioning unit all attached to said crimp device and adapted to engage the grip arm, said positioning unit having a housing and an operating means being adjustable relative to said housing along a second predetermined path generally parallel to the first predetermined path and including a locking means, said operating means being automatically lockable in and releasable from a plurality of positions along the second predetermined path by said locking means, each of said plurality of positions determining a different position of said crimp device along the first predetermined path at initial engagement between said positioning unit and said grip arm, whereby when said operating means is locked relative to said housing in one of said plurality of positions movement of said crimp device along the first predetermined path toward the crimping contact moves said positioning unit and said housing together along the second predetermined path, said positioning unit moving to initially engage the grip arm with said operating means and then moving the grip arm holding the cable end along the second predetermined path transverse to the longitudinal axis of the cable end until said crimp device stops moving along said first predetermined path.

2. The crimp press according to claim 1 wherein said operating means includes a bar guided in said housing, said bar being pressured in one direction along the second predetermined path by a spring means arranged on said housing.

3. The crimp press according to claim 2 wherein said bar has a gear tooth forming thereon engaging with a toothed connecting link guided in said housing, and including another spring means pressurizing said link into engagement with said gear tooth forming, said locking means including said gear toot forming, said link and said another spring means.

4. The crimp press according to claim 3 wherein said toothed connecting link is operated by an actuator, whereby when said actuator is activated, said actuator counteracts a spring resistance of said another spring means releasing engagement between said link and said gear tooth forming.

5. The crimp press according to claim 1 wherein said crimp device is oriented for movement in a generally vertical direction along the first predetermined path.

6. A crimp press for the production of a crimping connection utilizing a driven crimp device to connect a cable end with a crimping contact, wherein a grip arm supplies the cable end to the crimp press, the crimp press comprising:

a crimp device moveable along a predetermined path; and a positioning unit attached to said crimp device and adapted to engage the grip arm, said positioning unit having an operating means being adjustable along the predetermined path, said operating means being automatically lockable in and releasable from a plurality of positions along the predetermined path, said operating means including a bar guided in a housing, said bar being pressured in one direction along the predetermined path by a spring means arranged on said housing, said bar having a gear tooth forming thereon engaging with a toothed connecting link guided in said housing, and including another spring means pressurizing said link into engagement with said gear tooth forming.

7. The crimp press according to claim 6 wherein said toothed connecting link is operated by an actuator, whereby when said actuator is activated, said actuator counteracts a spring resistance of said another spring means releasing engagement between said link and said gear tooth forming.

8. The crimp press according to claim 6 wherein said crimp device is oriented for movement in a generally vertical direction along said predetermined path.

* * * * *